US007758004B2

(12) United States Patent
Brookman et al.

(10) Patent No.: US 7,758,004 B2
(45) Date of Patent: Jul. 20, 2010

(54) LOCKING MEMBER FOR A SELF CONTAINED BREATHING APPARATUS

(75) Inventors: Michael J. Brookman, Branford, CT (US); Michael B. Kay, Round Lake Beach, IL (US)

(73) Assignee: Interspiro, Inc., Pleasant Prairie, WI (US)

( * ) Notice: Subject to any disclaimer, the term of this patent is extended or adjusted under 35 U.S.C. 154(b) by 801 days.

(21) Appl. No.: 11/619,052

(22) Filed: Jan. 2, 2007

(65) Prior Publication Data

US 2007/0175470 A1 Aug. 2, 2007

Related U.S. Application Data

(60) Provisional application No. 60/757,160, filed on Jan. 5, 2006.

(51) Int. Cl.
*A47K 1/08* (2006.01)

(52) U.S. Cl. ..... 248/311.3; 248/312.1; 248/313; 248/316.1; 248/154; 294/31.1

(58) Field of Classification Search ..... 248/311.3, 248/312.1, 313, 316.1, 154, 220.21, 220.22, 248/221.11, 222.14, 222.52, 224.7; 294/31.1
See application file for complete search history.

(56) References Cited

U.S. PATENT DOCUMENTS 139,174 A * 5/1873 Merrill ..... 81/391

(Continued)

FOREIGN PATENT DOCUMENTS

EP 1 516 811 3/2005

(Continued)

OTHER PUBLICATIONS

International Search Report for International Application No. PCT/US2007/060085, dated Jun. 6, 2007.

(Continued)

*Primary Examiner*—J. Allen Shriver, II
*Assistant Examiner*—Michael McDuffie
(74) *Attorney, Agent, or Firm*—Marshall, Gerstein & Borun LLP

(57) ABSTRACT

A docking assembly for a self-contained breathing apparatus comprises a seat, a coupler, a pawl, and a spring. The self-contained breathing apparatus generally includes a compressed air tank having a head and a nozzle, the compressed air tank being adapted to deliver breathable air to a user. The seat of the docking assembly is adapted to releasably retain the head of the compressed air tank. The coupler comprises a plurality of circumferentially spaced teeth and a handle and is adapted for threaded engagement with the nozzle of the compressed air tank. The pawl is mounted to the seat for pivotal displacement and adapted to engage at least one of the plurality of teeth on the threaded coupler to lock the threaded coupler onto the nozzle. The spring biases the arm into the locked position.

21 Claims, 4 Drawing Sheets

U.S. PATENT DOCUMENTS 2,200,024 A * 5/1940 De Sipio et al. ..... 222/162
2,622,831 A * 12/1952 Fullwood ..... 248/292.12
4,049,164 A * 9/1977 Sullivan et al. ..... 224/633
5,080,414 A * 1/1992 Hellquist et al. ..... 294/31.1
5,301,634 A * 4/1994 Ho ..... 119/477
5,833,195 A * 11/1998 Haynes ..... 248/316.5
6,129,078 A * 10/2000 Moulder ..... 126/40
6,328,280 B1 12/2001 Davidson
6,682,028 B1 * 1/2004 Hackal ..... 248/145.3
7,287,735 B2 * 10/2007 Heerdt et al. ..... 248/311.2
7,448,586 B2 * 11/2008 Ziaylek et al. ..... 248/311.3

FOREIGN PATENT DOCUMENTS

WO WO-02/04292 1/2002

OTHER PUBLICATIONS

International Preliminary Report on Patentability for International Application No. PCT/US2007/060085, dated Jul. 8, 2008.

* cited by examiner

LOCKING MEMBER FOR A SELF CONTAINED BREATHING APPARATUS

CROSS-REFERENCE TO RELATED APPLICATIONS

This application is based on and claims the benefit of priority of U.S. Provisional Patent Application No. 60/757,160 filed Jan. 5, 2006, the entire contents of which are hereby expressly incorporated herein by reference.

FIELD OF THE INVENTION

The present invention relates generally to a self-contained breathing apparatus and, more particularly, to a locking mechanism for use with a docking assembly associated with a self-contained breathing apparatus.

BACKGROUND

High pressure breathing apparatus' commonly referred to as self-contained breathing apparatus' (SCBA) require a stored supply of breathable air, i.e., a compressed air tank, and a delivery system to convey the breathable air to a user. Common SCBA delivery systems generally include a regulator, one or more conduits, and a mask. Moreover, a threaded coupler is typically utilized to fluidly connect the compressed air tank to the delivery system. One known threaded coupler is designed to be manually threaded onto and off of a nozzle of the compressed air tank. This manual attachment/detachment enables a user to replace the compressed air tank in the field, such as at a contamination site, without the use of tools.

Unfortunately, however, such manually operable couplers are susceptible to being undesirably loosened due to impact, wear, vibrations, etc., during use in hazardous and/or dangerous environments. When the coupler loosens from the compressed air tank, leaking may occur, thereby reducing the available breathable air supply.

SUMMARY

The present invention provides a locking device for cooperation with an SCBA. The locking device maintains the ease of attachment/detachment generally associated with manual couplers, i.e., threaded connections, while providing a more mechanically secure connection. More particularly, the locking device comprises a ratchet wheel and a spring-biased pawl.

In one embodiment, the ratchet wheel is attached to or is provided as a part of a manual coupler. The pawl comprises a spring-biased lever or arm and a locking member including a locking edge disposed adjacent to a threaded connection of the compressed air tank. During use, the pawl intermittently engages the ratchet wheel as the coupler is threaded onto the threaded connection of the compressed air tank. Once the coupler is threaded onto the compressed air tank to a desired tightness, the pawl engages one of a plurality of teeth on the ratchet wheel. So configured, the pawl applies a force to the tooth of the ratchet wheel disposed on the coupler and operates to prevent the coupler from loosening off of the compressed air tank.

If a user wishes to remove and replace the compressed air tank, the user applies a force against the bias of the pawl to disengage the pawl from the coupler. Thereafter, a user may freely rotate the coupler out of threaded engagement with the compressed air tank.

DETAILED DESCRIPTION

Figure 1:
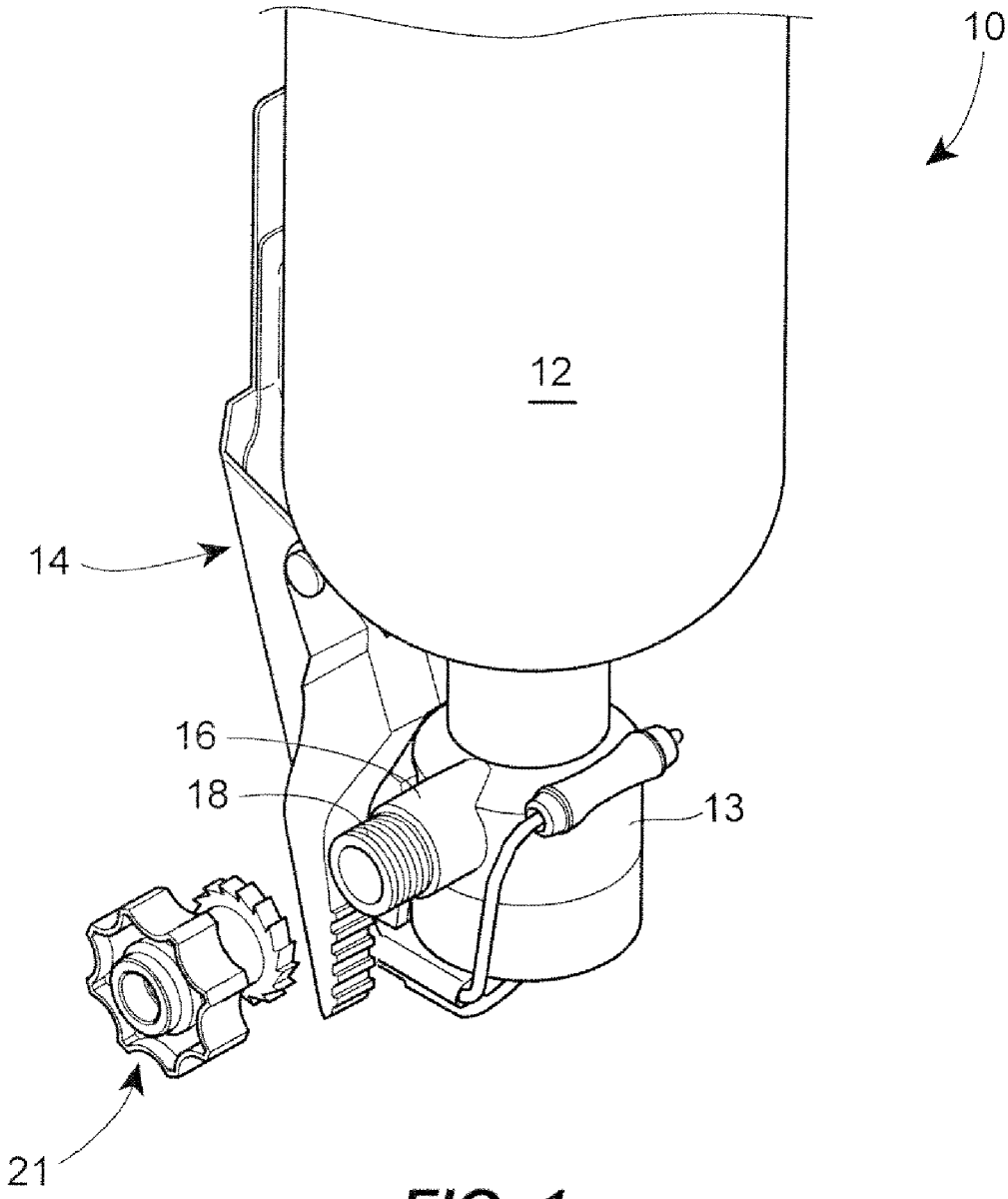
FIG. 1 is a perspective view of a portion of an SCBA comprising a compressed air tank and a docking assembly constructed in accordance with the principles of the present invention.

Referring to FIG. 1, a self-contained breathing apparatus (SCBA) 10 constructed in accordance with the principles of the present invention is illustrated as comprising a compressed air tank 12, i.e., an oxygen tank, and a docking assembly 14 including a coupler 21. In one form, the SCBA unit or docking assembly 14 may be based on or include a modified version of the Rapid Intervention Connection (RIC) or Universal Air Connection (UAC) component of the Spiromatic-S4 SCBA, which is commercially available from Interspiro, Inc. of Pleasant Prairie, Wis. The compressed air tank 12 comprises a head 13 and a connection member or nozzle 16. The nozzle 16 includes a plurality of threads 18 disposed on the external surface thereof and a nipple orifice 20 disposed on the interior thereof. The coupler 21 is adapted to threadably engage the nozzle 16 such that the orifice 20 accepts and sealingly engages a corresponding nipple tip 44 (shown in FIG. 4) supported by the coupler 21. The nipple tip 44 is disposed in communication with a fluid delivery system of the SCBA including, for example, a regulator (not shown) and/or a mask (not shown), as is known within the art.

As depicted in FIG. 1, the docking assembly 14 is adapted to receive and retain the head 13 of the compressed air tank 12. Accordingly, in one embodiment of the SCBA 10, the docking assembly 14 may be fixed to a back-pack, a safety suit, or any other garment or accessory typically worn by first-response personnel, firefighters, etc. Furthermore, as will be described in much detail below, the docking assembly 14 and coupler 21 are arranged and configured to cooperatively retain and lock the coupler 21 in threaded engagement with the nozzle 16 of the compressed air tank 12. Such locking retention of the coupler 21 advantageously ensures efficient operation of the SCBA 10 and reduces the potential for leakage of the contents of the tank 12 at this junction.

Figure 2:
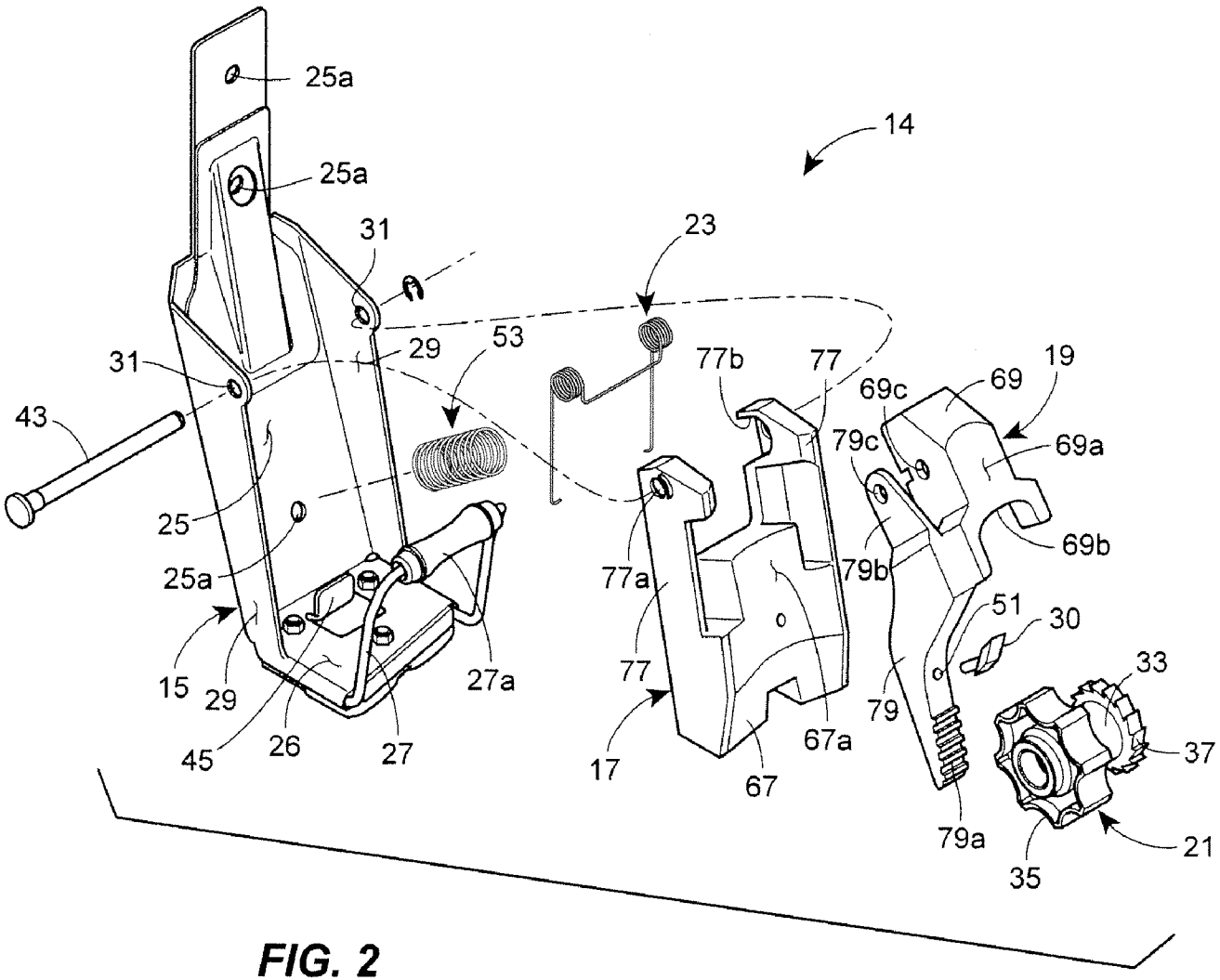
FIG. 2 is a partially exploded perspective view of the docking assembly of FIG. 1.

FIG. 2 depicts the docking assembly 14 generally comprising a frame 15, a seat 17, a brake 19, a torsion spring 23, a compression spring 53, a pin 43, and the aforementioned coupler 21. The frame 15 comprises a back-plate 25, a base 26, and a fence 27. The back-plate 25 and base 26 are integrally formed from a metal plate that includes a plurality of apertures 25*a* for receiving fasteners such as bolts, rivets, or screws, for attaching the docking assembly 14 to a garment or accessory. Moreover, the frame 15 comprises side plates 29 having apertures 31 for receiving the pin 43 for operably retaining the seat 17 and the brake 19, as will be described in more detail below. The fence 27 comprises a wire loop formed in an upside-down U-shape and carrying a roll guard 27*a*. The fence 27 cooperates with the seat 17 and brake 19 to engage and retain the head 13 of the compressed air tank 12 within the docking assembly 14, as illustrated in FIG. 1.

With continued reference to FIG. 2, the seat 17 of the docking assembly 14 is formed of a rigid body and generally comprises a central portion 67 and a pair of arm portions 77. The central portion 67 defines a concave surface 67*a* that is dimensioned to accommodate the cylindrical head 13 of the compressed air tank 12 in cooperation with the base 26 and fence 27 of the frame 15. The pair of arm portions 77 each include a pivot aperture 77*a*, only one of which is visible in FIG. 2. The pivot apertures 77*a* are adapted to receive the pin 43 for mounting the seat 17 to the frame 15 and enabling pivoting of the seat 17 relative to the frame 15, as will be described below. Moreover, the pair of arm portions 77 each define a recess or spring seat 77*b*, only one of which is visible in FIG. 2. The spring seats 77*b* are for receiving and supporting the torsion spring 23 between the frame 15 and the seat 17, thereby biasing the seat 17 relative to the frame 15 and the brake 19, as will be described in further detail below.

The brake 19 is also formed of a rigid body and generally comprises a braking portion 69 and a lever portion or arm 79. The braking portion 69 defines a concave surface 69*a*, a braking surface 69*b*, and a pivot bore 69*c*. Similar to the pivot apertures 77*a* in the arm portions 77 of the seat 17, the pivot bore 69*c* is adapted to receive the pin 43 for enabling pivoting of the brake 19 when assembled within the frame 15. The concave surface 69*a* of the brake 19 is dimensioned to accommodate a portion of the compressed air tank 12 disposed immediately below the head 13, as shown in FIG. 1, for example. The braking surface 69*b* of the brake 19 is substantially U-shaped and adapted to be engaged by the head 13 of the compressed air tank 12, as is also shown in FIG. 1. So configured, the braking surface 99*b* of the head 19 retains the compressed air tank 12 in engagement with the docking assembly 14 by limiting displacement of the head 13 upward relative to the seat 17, as oriented in FIGS. 1 and 2.

The lever portion or arm 79 of the brake 19 comprises an elongated member integrally formed with the braking portion 69. The lever portion or arm 79 comprises a knurled end 79*a* and a flanged end 79*b*, which defines a pivot aperture 79*c*. The pivot aperture 79*c* is substantially aligned with the pivot bore 69*c* in the braking portion 69 of the brake 19, and similarly adapted to receive the pin 43.

Thus, when assembled, the seat 17 and brake 19 are pivotally coupled within the frame 15 via the pin 43. More specifically, the seat 17 is pivotally mounted to the pin 43 and biased by the compression spring 53 away from the back-plate 25 of the frame 15. In the disclosed embodiment, a stop 45 extends upward from the base 26 of the frame 15 and restricts the distance which the compression spring 53 displaces the bottom portion of the seat 17 away from the back-plate 25 of the frame 15. Similarly, the brake is pivotally mounted to the pin 43 and biased by the torsion spring 23 such that the knurled end 79*a* of the lever portion or arm 79 is forced away from the back-plate 25 of the frame 15.

Accordingly, during operation, the brake 19 may be pivoted between the braking position (shown in FIG. 1) and a release position (not shown). In the braking position, the concave surface 69*a* of the braking portion 69 of the brake 19 is positioned away from, and at an angle relative to, the concave surface 67*a* of the central portion 67 of the seat 17, thereby exposing the braking surface 69*b*. So configured, in the disclosed embodiment, the exposed braking surface 69*b* extends generally perpendicularly between the concave surfaces 67*a*, 69*a*. Alternatively, in the release position, the concave surface 69*a* of the braking portion 69 of the brake 19 is positioned in general alignment with the concave surface 67*a* of central portion 67 of the seat 17. This hides the braking surface 69*b* between the arm portions 77 of the seat 17 such as to provide a smooth, continuous transition between the concave surfaces 69*a*, 67*b*. So configured, a user may freely slide the head 13 of the compressed air tank 12 into engagement with the docking assembly 14, as depicted in FIG. 1.

Moreover, as mentioned, the present example of the docking assembly 14 includes the seat 17 being pivotably mounted to the pin 43 and biased by the compression spring 53. Therefore, when a user slides the head 13 of the compressed air tank 12 passed the brake 19 and into the docking assembly 14 the head 13 forcibly pivots the seat 17 slightly about the pin 43, thereby slightly compressing the compression spring 53. So configured, the compression spring 53 applies a force to the seat 17 and the seat 17, in turn, applies a force to the head 13 of the compressed air tank 12. This force applied by the seat 17 ensures that the head 13 of the compressed air tank 12 appropriately abuts the fence 27 to secure the tank 12 in the docking assembly 14.

Additionally, as mentioned and depicted in FIGS. 1 and 2, the brake 19 includes the lever portion or arm 79. The lever portion or arm 79 is adapted to be manipulated by a user to pivot the brake 19 from the braking position (shown in FIG. 1) to the release position (not shown) against the bias of the torsion spring 23, thereby enabling a user to remove the head 13 of the compressed air tank 12 from the docking assembly 14. For example, when the brake 19 is in the braking position (FIG. 1), a user may apply a generally normal force to the knurled end 79*a* of the lever portion or arm 79. The brake 19 rotates around the pin 43 into the released position, wherein the concave surfaces 67*a*, 69*a* are generally aligned. The user can then remove the compressed air tank 12 from the docking assembly 14. Thereafter, the user may release the force applied to the lever portion or arm 79, thereby enabling the torsion spring 23 to bias the brake 19 back toward the braking position (FIG. 1).

It should be appreciated that the roll guard 27*a* disposed on the fence 27 assists the user in both moving the head 13 of the compressed air tank 12 into and out of engagement with the docking assembly 14. Specifically, the roll guard 27*a* comprises a contoured sleeve disposed for rotational displacement on the fence 27. Accordingly, as the user moves the head 13 of the compressed air tank 12 relative to the docking assembly 14, as described above, the roll guard 27*a* is engaged by the head 13 and rotates. Thus, the rotation of the roll guard 27*a* advantageously reduces friction between the head 13 and the fence 27 and assists the user with moving the compressed air tank 12 into and out of engagement with the docking assembly 14.

As mentioned above, the docking assembly 14 just described is adapted to lock the coupler 21 in threaded engagement with the nozzle 16 of the compressed air tank 12. In the disclosed embodiment, this locking feature is achieved through the incorporation of a locking member 30 (shown generally in FIG. 3) with the brake 19 and a ratchet wheel 37 (also shown generally in FIG. 3) with the coupler 21.

Figure 3:
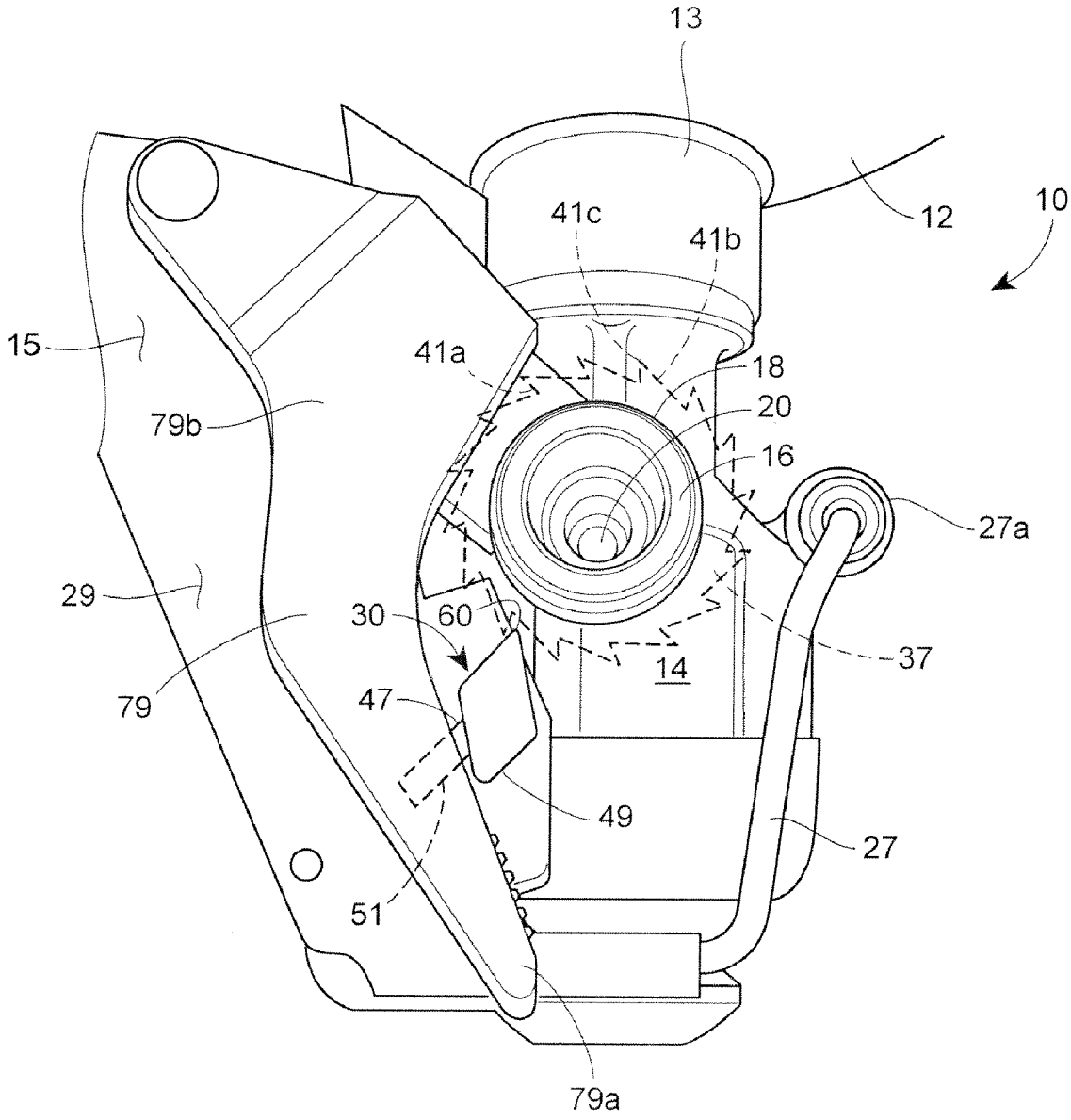
FIG. 3 is a partial side perspective view of the docking assembly of FIG. 1 receiving a head of the compressed air tank and showing a portion of a coupler in hidden lines and locked in threaded engagement with a nozzle of the compressed air tank.
Figure 4:
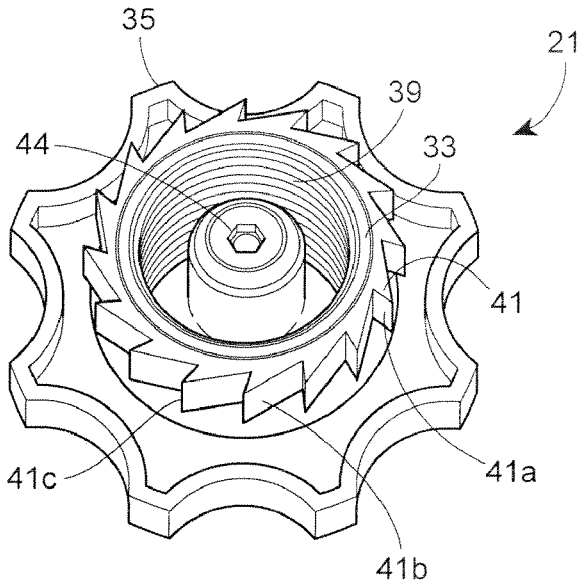
FIG. 4 is a detailed perspective view of the coupler of the coupler of FIGS. 1 and 3.

More specifically and with reference to FIGS. 2-4, one coupler 21, which is constructed in accordance with the present disclosure, comprises a central barrel 33, a handle 35, and the aforementioned ratchet wheel 37. The barrel 33 comprises a generally hollow cylinder adapted to receive a nipple tip, such as nipple tip 44 depicted in FIG. 4. In one embodiment, the nipple tip 44 is attached to the coupler 21 and associated with a conduit or regulator, for example, for delivering breathable air in a controlled manner to a user. The barrel 33 includes a plurality of internal threads 39 (shown in FIG. 4) adapted for threaded engagement with the threads 18 on the nozzle 16 of the compressed air tank 12. The ratchet wheel 37 comprises a plurality of ratchet teeth 41, which will be described in more detail below with reference to FIG. 5, and is rigidly connected to an external surface of the barrel 33. The handle 35 is also rigidly connected to the external surface of the barrel 33 and is adapted to be manually grasped by a user to thread the coupler 21 onto, and off of, the nozzle 16 of the compressed air tank 12.

Moreover, in the disclosed embodiment, the locking member 30 is mounted to the lever portion or arm 79 approximately adjacent the knurled end 79*a*. The locking member 30 comprises a pin 47 and a body 49. The pin 47 is fixedly disposed in a bore 51 (shown in FIGS. 2 and 3) formed in the lever portion or arm 79. In one form, the pin 47 may be secured within the bore 51 with an adhesive. In another form, the pin 47 may be threaded into the bore 51. In alternative embodiments, the locking member 30 may be formed integral with the lever portion or arm 79, or may be otherwise rigidly formed with or attached to the lever portion or arm 79, or other portion of the seat 17. In all these examples, the locking member 30 is carried by the seat 17.

Figure 6A:
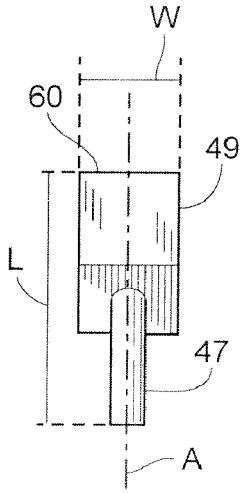
FIG. 6A is a front view of a locking member of the docking assembly of FIGS. 1-3.
Figure 6B:
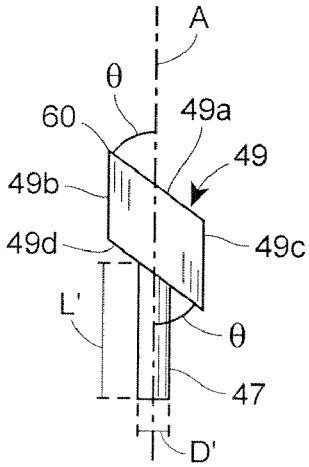
FIG. 6B is a schematic side view of the locking member of FIG. 6A.

The body 49 of the locking member 30 comprises a generally box-shaped structure having a generally diamond or rhombus-shaped side profile, as depicted in FIGS. 3 and 6B. So configured, the body 49 defines a locking edge 60. As depicted in FIG. 3, the locking edge 60 is adapted to engage the ratchet wheel 37 of the coupler 21 to lock the coupler 21 onto the nozzle 16 of the compressed air tank 12. Thus, as described above, the bias of the torsion spring 23 pivots the brake 19 and the lever portion or arm 79 thereof into the braking position, which is depicted in FIGS. 1 and 3. Therefore, the torsion spring 23 biases the lever portion or arm 79 and thus, the locking edge 60 of the locking member 30, toward the nozzle 16 of the compressed air tank 12.

More specifically, as depicted in FIG. 3, the lever portion or arm 79 is biased such that the locking edge 60 of the locking member 30 engages the ratchet wheel 37 of the coupler 21. So configured, the lever portion or arm 79 and the locking member 30 effectively function as a spring-biased pawl adapted to engage the ratchet wheel 37 and the lock the coupler 21 on the nozzle 16 of the compressed air tank 12. More particularly, the lever portion or arm 79 and the locking member 30 prevent the coupler from rotating out of threaded engagement with the nozzle 16.

As mentioned above, the ratchet wheel 37 of the coupler 21 includes a plurality of ratchet teeth 41. FIGS. 3 and 4 illustrate each of the plurality of ratchet teeth 41 including a locking face 41*a*, a tail face 41*b*, and a tip 41*c*. Accordingly, when the brake 19, and therefore the lever portion or arm 79, is in the braking position, the locking edge 60 of the locking member 30 applies a force to the locking face 41*a* of one of the plurality of teeth 41 on the ratchet wheel 37. This force applied by the locking member 30 is directed generally tangential to the barrel 33 of the coupler 21 in the clockwise direction relative to the orientation of FIG. 3. Accordingly, the locking member 30 prevents the coupler 21 from rotating in the counter-clockwise direction.

During use, a user threadably attaches the coupler 21 to the compressed air tank 12 by rotating the coupler 21 in the clockwise direction relative to the orientation of the nozzle 16 depicted in FIG. 3. The engagement between the internal threads 39 of the barrel 33 and the external threads 18 of the nozzle 16 draws the coupler 21 onto the nozzle 16 and the nipple tip 44 into sealing engagement with the nipple orifice 20. At some point in the process, generally when the nipple tip 44 is close to sealingly engaging the nipple orifice 20, the locking edge 60 of the locking member 30 will begin to slidably engage the teeth 41 of the ratchet wheel 37. For example, with reference to FIG. 3, while the coupler 21 is rotated in the clockwise direction, the tail surfaces 41*b* of the teeth 41 of the ratchet wheel 37 intermittently engage and ride over or slide past the locking edge 60 of the locking member 30. Such intermittent engagement intermittently displaces the locking member 30, and therefore the lever portion or arm 79, a negligible amount away from the coupler 21 against the bias of the torsion spring 23. However, as mentioned above, once the coupler 21 is tightened a desired amount, the coupler 21 may be rotated slightly in the counter-clockwise direction such that the locking edge 60 of the locking member 30 engages the locking face 41*a* of one of the teeth 41. This engagement prevents the coupler 21 from rotating counter-clockwise or in a disengaging direction. In this manner, the locking member 30 operates in conjunction with the ratchet wheel 37 to provide a positive locking feature that prevents rotation of the coupler 21 in the disengaging direction, thereby maintaining the nipple tip 44 in sealing engagement with the nipple orifice 20 of the nozzle 16 to prevent leakage.

To remove the coupler 21 from the nozzle 16, the user must apply a force to the knurled end 79*a* of the lever portion or arm 79 to pivot the arm 79 against the bias of the torsion spring 23. This moves the locking member 30 out of engagement with the ratchet wheel 37, thereby enabling the user to freely spin the coupler 21 in the counter-clockwise direction relative to the orientation of FIG. 3.

In one embodiment, the body 49 of the locking member 30 is dimensioned to have a predetermined thickness, wherein the ratchet wheel 37 does not engage the locking edge 60 until the coupler 21 is almost completely tightened onto the nozzle 16. For example, when configured as desired, the tail surfaces 41*b* of the teeth 41 on the ratchet wheel 37 may only begin to ride over the locking member 30 during the last 10%, for example, of the rotating motion required to reach a desired tightness of the coupler 21 on the nozzle 16. One embodiment may be designed such that a predetermined number or limited number of teeth 41 on the ratchet wheel 37 ride over the locking member 30 before the nipple tip 44 fully engages and seals with the nipple orifice 20. This configuration advantageously enables a user to rotate the coupler 21 onto the nozzle 16 without interference from the locking member 30, until immediately or shortly before the nipple tip 44 fully engages the nipple orifice 20. Furthermore, this configuration only requires the user to displace the lever portion or arm 79 against the bias of the spring 23 for a short time during removal of the coupler 21, i.e., the first 10% of the removal operation.

As described above, during operation, to install the coupler 21 on the nozzle 16, the coupler 21 is first is placed on the nozzle 16 so that the threads 18 on the nozzle 16 begin to engage the internal threads 39 on the barrel 33. A user may then freely rotate the coupler 21 until the point at which the nipple tip 44 begins to sealingly engage the nipple orifice 20. The tail surfaces 41*b* of the teeth 41 of the ratchet wheel 37 will then begin to engage and ride over the locking edge 60 of the locking member 30, which may provide a clicking sound. In one embodiment, the user then continues to rotate the coupler 21 via the handle 35 for any given number of clicks defined by each of the plurality of teeth 41 riding past the locking edge 60 of the locking member 30. In one embodiment, the clicks provide positive feedback to the user, thereby enabling the user to assess whether the coupler 21 is threaded onto the nozzle 16 of the compressed air tank 12 the predetermined desired amount. In an alternative embodiment, the user may rotate the handle 35 of the coupler 21 until no further rotation is possible and, if desired may pivot the lever portion or arm 79 against the bias of the spring 23 to make such rotation easier. In any event, after the coupler 21 is securely threaded onto the nozzle 16 of the compressed air tank 12, the coupler 21 will be disposed such that the nipple tip 44 fully sealingly engages the nipple orifice 20 and the locking edge 60 of the locking member 30 engages a locking face 41 a of one of the plurality of teeth 41 of the ratchet wheel 37. Accordingly, the spring biased lever portion or arm 79 and locking member 30 operate as a spring-biased pawl in engagement with the ratchet wheel 37 to prevent rotation of the coupler 21 out of engagement with the nozzle 16.

Thereafter, to remove the coupler 21 from the nozzle 16, a user must first pivot the lever portion or arm 79 and locking member 30 against the bias of the spring 23 and out of engagement with the ratchet wheel 37. The user may then rotate the coupler 21 via the handle 35 in the counter-clockwise direction relative to the orientation of FIG. 3, for example, thereby allowing the threads 18, 39 on the nozzle 16 and barrel 33, respectively, to force the coupler 21 off of the nozzle 16. This simultaneously disengages the nipple tip 44 from the nipple orifice 20. After a short amount of time, such as a couple of turns or even less than a full turn, the coupler 21 moves sufficiently off of the nozzle 16 such that the locking member 30 can no longer engage the ratchet wheel 37. At this point, the user may release the lever portion or arm 79 and freely rotate or spin the coupler 21 off of the nozzle 16.

Figure 5:
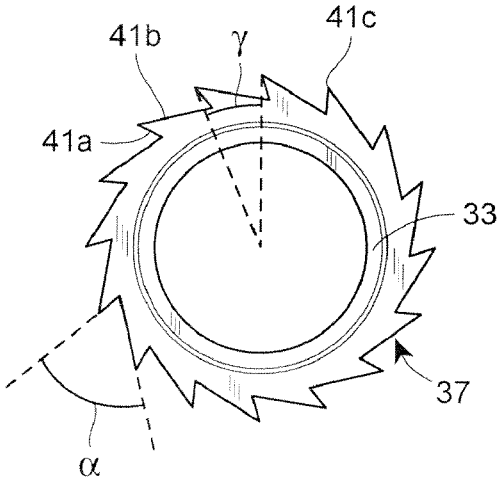
FIG. 5 is a plan view of the ratchet wheel of FIGS. 1, 3, and 4.

As mentioned, the ratchet wheel 37 of the disclosed embodiment comprises a plurality of ratchet teeth 37, each comprising a locking face 41*a* and a tail face 41*b*. FIG. 5 schematically depicts one example of a functional geometry of the ratchet wheel 37 fixed onto the barrel 33 of the coupler 21. Specifically, the locking face 41*a* of each of the plurality of teeth 41 includes a linear dimension that is less than a linear dimension of the tail face 41*b*. Furthermore, the locking face 41*a* of each of the plurality of teeth 41 is disposed at an angle $\alpha$ relative to the tail face 41*b*. In one embodiment, the angle $\alpha$ is less than 90° and most preferably 60°. Moreover, the tips 41*c* of each of the plurality of teeth 41 are spaced circumferentially about the ratchet wheel 37, each tip 41*c* being offset an angle $\gamma$ from the adjacent tips 41*c*. In a preferred embodiment, the angle $\gamma$ is approximately 24° and the plurality of teeth 41 comprises fifteen teeth 41. Further yet, in a preferred form of the coupler 21 designed to work in cooperation with the Spiromatic-S4 SCBA commercially available from Interspiro, Inc. of Pleasant Prairie, Wis., the barrel 33 of the coupler 21 includes an outside diameter of approximately 26.2 millimeters. Accordingly, a preferred embodiment of the ratchet wheel 37 such as that depicted in FIG. 5, comprises an inside diameter of approximately 26.2 millimeters or slightly larger to enable proper assembly. Additionally, the ratchet wheel 37 comprises a tip diameter, which is measured at the tips 41*c* of each of the plurality of teeth 41, of approximately 33.753 millimeters. Finally, the ratchet wheel 37 comprises a locking diameter, which is measured at the intersection of the locking face 41*a* and the tail face 41*b*, of approximately 29.2 millimeters. It should be appreciated that while the ratchet wheel 37 and barrel 33 of the coupler 21 have been depicted and described herein as comprising separate components, alternative embodiments of the docking assembly 14 may comprise a coupler 21 having a ratchet wheel 37 that is integrally combined and/or formed with the barrel 33.

FIGS. 6A and 6B depict one design of a locking member 30 constructed in accordance with the principles of the present invention and designed to work in cooperation with the Spiromatic-S4 SCBA commercially available from Interspiro, Inc. of Pleasant Prairie, Wis. Specifically, as mentioned above, the locking member 30 comprises a pin 47 and a body 49. The pin 47 is disposed along an axis A. The body 49, as discussed above, is generally diamond or rhombus-shaped and includes a locking edge 60. Additionally, for the sake of description, the body 49 comprises a front surface 49*a*, a rear surface 49*b*, a top surface 49*c*, and a bottom surface 49*d*. The front and rear surfaces 49*a*, 49*b* are disposed at an angle $\theta$ relative to the axis A of the pin 47. In a preferred embodiment, the angle $\theta$ is approximately 35°. In one embodiment, the locking member 30 is formed of a single piece of rigid material such as steel. The locking member 30 comprises an overall length dimension L and a width dimension W. In one preferred embodiment, the overall length dimension L is approximately 23.39 millimeters and the width dimension W is approximately 9.132 millimeters. Moreover, in one preferred embodiment, the pin 47 has a diameter D' of approximately 3.175 millimeters and a pin-side length dimension L' of the locking member 30 is approximately 14 millimeters.

In view of the foregoing, it should be appreciate that the disclosed preferable dimensions of the ratchet wheel 37, barrel 33, and locking member 30 are merely examples, and for use in one particular application with the Spiromatic-S4 SCBA mentioned above. Accordingly, such dimensions are provided herein for the sake of completeness and are not intended to limit the scope of the present invention beyond that which is defined by the claims.

Furthermore, it should be appreciated that while the body 49 of the locking member 30 has been disclosed herein as including a generally diamond or rhombus-shaped side profile defining the locking edge 60, alternative embodiments of the docking assembly 14 may be designed differently to achieve the same or a comparable result. For example, the body 49 of the locking member 30 may comprise generally any shape capable of providing a surface, or edge, similar to the locking edge 60 for engaging a corresponding surface of the coupler 21 to prevent the coupler 21 from loosening off of the nozzle 16.

In light of the foregoing, it should therefore be appreciated that a docking assembly 14 constructed in accordance with the present invention advantageously provides a system that enables quick, easy, and secure attachment and detachment of a compressed air tank 12. Specifically, the spring-biased pawl of the present disclosure, which includes the lever portion or arm 79 and the locking member 30 biased by the torsion spring 23, provides for an automatic locking feature that prevents loosening of the coupler 21, and therefore loosening of the nipple tip 44 from the nipple orifice 20, to thereby minimize leakage of air from the compressed air tank 12. Furthermore, the configuration of the locking member 30 in relation to the ratchet wheel 37 of the coupler 21 provides for an easy and quick detachment of the coupler 21 from the nozzle 16. For example, as described above, in one embodiment, the ratchet wheel 37 should be located on the barrel 33 of the coupler 21 such that the teeth 41 thereof only begin to slidingly engage the locking member 30 when the coupler 21 is nearly completely threaded onto the nozzle 16. Accordingly, the user need only depress the lever portion or arm 79 and push the locking member 30 out of engagement with the ratchet wheel 37 for a brief period of time at the beginning of the detachment process. This provides for an efficient detachment process by allowing the user to quickly spin the coupler 21 off of the nozzle 16.

Finally, in view of the foregoing, it should be appreciated that the embodiments of the SCBA and, particularly the docking assembly 14 including the coupler 21, described herein are merely examples of the present invention. The spirit and scope of the invention is not limited to or by these examples, but rather, is defined by the claims.

What is claimed is:

1. A docking assembly for a compressed air tank having a head and a nozzle, the compressed air tank adapted to deliver breathable air to a user, the docking assembly comprising:

a seat adapted to releasably retain the head of the compressed air tank;

a coupler adapted for threaded engagement with the nozzle of the compressed air tank; and a locking member carried by the seat and comprising a locking edge adapted to engage the coupler to maintain the coupler in threaded engagement with the nozzle.

2. The docking assembly of claim 1, further comprising a spring biasing the locking member into engagement with the coupler.

3. The docking assembly of claim 1, wherein the coupler comprises a cylinder having an outer surface and at least one tooth disposed on the outer surface such that the locking member is adapted to engage the at least one tooth.

4. The docking assembly of claim 3, wherein the at least one tooth comprises a plurality of teeth disposed circumferentially about the outer surface of the cylinder such that the locking member is adapted to engage any one of the plurality of teeth.

5. The docking assembly of claim 3, wherein the coupler further comprises a handle fixed to the cylinder, wherein the handle is adapted to enable a user to manually thread the coupler onto the nozzle.

6. The docking assembly of claim 2, wherein the spring comprises a torsion spring disposed between the seat and the locking member.

7. The docking assembly of claim 1, further comprising an arm carrying the locking member, the arm pivotally coupled to the seat and biased into a locked position by the spring wherein the locking member engages the coupler.

8. The docking assembly of claim 1, further comprising a frame carrying the seat and the locking member.

9. A docking assembly for a compressed air tank having a head and a nozzle, the compressed air tank adapted to deliver breathable air to a user, the docking assembly comprising:

a seat adapted to releasably retain the head of the compressed air tank;

a threaded coupler adapted for threaded engagement with the nozzle of the compressed air tank and comprising a plurality of circumferentially spaced teeth and a handle;

an arm mounted to the seat for pivotal displacement between an unlocked position and a locked position;

a locking member carried by the arm and adapted to engage at least one of the plurality of teeth on the threaded coupler when the arm is disposed in the locked position; and a spring engaging the arm and biasing the arm into the locked position.

10. The docking assembly of claim 9, wherein the threaded coupler comprises a cylinder having an outer surface carrying the plurality of teeth.

11. The docking assembly of claim 10, wherein the threaded coupler further comprises a handle for enabling a user to manually thread the coupler onto the nozzle of the compressed air tank.

12. The docking assembly of claim 9, wherein the spring comprises a torsion spring.

13. The docking assembly of claim 9, wherein the locking member comprises a locking edge adapted to engage at least one of the plurality of teeth on the threaded coupler.

14. The docking assembly of claim 9, further comprising a frame carrying the seat, the arm, and the spring.

15. A method of releasably securing a compressed air tank to a docking assembly of a breathing apparatus, the method comprising:

positioning a head of the compressed air tank into engagement with a seat of the docking assembly;

rotating a coupler in a first direction into threaded engagement with a nozzle of the compressed air tank, the nozzle being disposed adjacent the head; and biasing a locking member carried by the docking assembly into engagement with the coupler such that the locking member applies a force to the coupler preventing the coupler from rotating in a second direction that is opposite the first direction.

16. The method of claim 15, wherein biasing the locking member into engagement with the coupler comprises biasing the locking member into locking engagement with a tooth disposed on the coupler.

17. The method of claim 15, wherein biasing the locking member into engagement with the coupler comprises biasing the locking member into locking engagement with at least one of a plurality of teeth disposed on the coupler.

18. The method of claim 15, wherein biasing the locking member into engagement with the coupler comprises biasing a locking edge of the locking member into locking engagement with the coupler.

19. The method of claim 15, wherein rotating the coupler into threaded engagement with the nozzle comprises rotating the coupler in intermittent sliding engagement with the locking member.

20. The method of claim 15, wherein positioning the head of the compressed air tank into engagement with the seat of the docking assembly comprises forcing a brake component of the docking assembly against the bias of a spring.

21. The method of claim 20, wherein biasing the locking member into engagement with the coupler comprises biasing an arm relative to the seat, the arm carrying the locking member and being connected to the brake component.

* * * * *